United States Patent [19]

Hemphill

[11] Patent Number: 4,835,888

[45] Date of Patent: Jun. 6, 1989

[54] EXCAVATING TOOTH AND HOLDER THEREFOR

[76] Inventor: Charles W. Hemphill, 1106 Green Valley La., Duncanville, Tex. 75137

[21] Appl. No.: 44,603

[22] Filed: May 1, 1987

[51] Int. Cl.[4] ..... F02F 9/28

[52] U.S. Cl. ..... 37/141 T; 37/142 R; 37/142 A

[58] Field of Search ..... 37/141 R, 141 T, 142 R, 37/142 A

[56] References Cited

U.S. PATENT DOCUMENTS

| | | | |
|---|---|---|---|
| 2,861,362 | 11/1958 | Liard et al. | 37/142 |
| 2,891,333 | 6/1959 | Van Buskirk | 37/142 |
| 2,904,908 | 9/1959 | Ratkowski | 37/142 |
| 3,312,004 | 4/1967 | Johnson | 37/142 |
| 3,456,370 | 7/1969 | Gilbertson | 37/141 R |
| 3,888,028 | 6/1975 | White | 37/142 R |
| 4,205,469 | 6/1980 | Johansson et al. | 37/142 |
| 4,213,257 | 7/1980 | Johansson et al. | 37/142 |
| 4,251,933 | 2/1981 | Hemphill | 37/141 R |
| 4,449,309 | 5/1984 | Hemphill | 37/141 R |
| 4,476,642 | 10/1984 | Hemphill | 37/142 R |
| 4,611,418 | 9/1986 | Launder | 37/142 A X |

*Primary Examiner*—Edgar S. Burr
*Assistant Examiner*—Moshe I. Cohen
*Attorney, Agent, or Firm*—Marcus L. Bates

[57] ABSTRACT

A digging tooth and holder therefor for use with an excavating machine including trenchers and backhoe buckets. The tooth holder is suitably attached to the excavating machine, and includes a tooth receiving pocket formed therein for removably receiving the shank of a digging tooth in an improved manner therein. The digging tooth shank rearwardly extends from the tooth and is made into a special configuration which enables power applied thereto from the excavating machine to be transferred into the working end of the tooth in a new and unusual manner. The working end of the tooth inculdes an elongated, concave upper surface, a cylindrical lower surface, and a plurality of longitudinal extending reinforcing ribs which are formed on the cylindrical lower surface, all of which cooperate together to impart great strength into the tooth and also enables the tooth to dig in hard formations in an improved manner.

17 Claims, 3 Drawing Sheets

EXCAVATING TOOTH AND HOLDER THEREFOR

BACKGROUND OF THE INVENTION

As increased digging force is applied to the holder of a digging tooth, the tooth eventually is forced to enter the ground and excavate material or otherwise, the tooth breaks. Usually, before the tooth can be broken, maximum power from the excavating machine is achieved or alternatively, the formation permits the tooth to penetrate and excavate, so the tooth usually survives. Sometimes the power applied to the tooth is insufficient to break the tooth and sometimes the geological strata is too soft to cause the tooth to break, so digging proceeds in an orderly manner.

Most digging teeth can be broken somehow or another, as for example lifting the bucket high into the air and dropping it from a great height in an attempt to clean the bucket. Should the bucket teeth strike a hard surface under these conditions, some teeth invariably will not have the structural integrity required to endure this mistreatment and they break.

A unitary digging tooth that is directly attached to the bucket lip is most likely not to break as compared to a tooth which is removably received within a pocket. It would therefore be desirable to have a tooth of unitary construction which is directly welded onto the lip of a bucket, for example, so that the tooth could exhibit great strength that is directly proportional to its cross-sectional area, composition of material, and geometrical configuration. Such a design would provide a very strong tooth of great durability; however, the tooth would be impractical for most excavating machines because digging teeth sometime must be replaced after only a few hours of use; and, therefore, it would be necessary to replace the entire tooth assembly, or alternatively, have made available a bucket lip that was replaceable such as shown in U.S. Pat. Nos. 848,743 and 2,660,323.

The present invention provides a digging tooth assembly comprised of a digging tooth and holder that resists breaking because of the unusual manner by which they are joined together. The tooth digs more efficiently because the unique configuration of the working end of the tooth is designed to enter hard formations with minimum applied force. Moreover, the design of the tooth causes the cutting edges thereof to remain in a condition for efficiently digging for a long time. The tooth of the present invention therefore transfers power applied from the excavating machine into the working end of the tooth in a superior manner. All of these desirable features of a digging tooth made in accordance with the present invention provides unusual and unexpected results.

In my previous U.S. Pat. No. 4,476,642, there is set forth a digging tooth and holder assembly made for either a trencher or a bucket. The present invention is an improvement over this prior patent because of the configuration of the working end of the tooth as well as the configuration of the shank and pocket therefor.

SUMMARY OF THE INVENTION

The present invention comprehends an improved digging tooth and holder therefor for use in conjunction with an excavating machine. The tooth has a working part opposed to a shank. The working part initially engages and excavates material while the shank is utilized for removably mounting the tooth to the holder which in turn is affixed to the excavating machine. The forward end of the holder is provided with a shank receiving pocket, and means are provided by which the holder can be affixed to and thereby form part of the excavating machine.

The bottom surface of the holder and tooth combination are both curved cylindrically and form a semicircle when viewed in lateral cross-section. The top surface of both the holder and the tooth is curved to form an elongated trough which is concave in lateral cross-section. A plurality of parallel, longitudinally extending ribs are formed on the bottom of the working end of the tooth, with the ribs commencing at the forwardmost end of the working part of the tooth and terminating adjacent to the shank at the rear of the working part of the tooth.

The tooth includes a lateral shoulder formed at the location where the shank is joined to the rear working end of the tooth. The tooth holder includes a lateral shoulder formed at the upper, forward part thereof that defines part of the pocket entrance. The two lateral shoulders are spaced from one another. The upper surface of the shank is curved into a concave configuration and a lower surface thereof is of a conical configuration. The shank's upper and lower surfaces converge towards one another so that the area and thickness of the shank diminishes in a rearward direction. The upper and lower surfaces of the shank are joined at a shoulder which commences at the opposed sidewalls of the digging tooth, converge in a rearward direction, and terminate in joined relationship to form the rear terminal end of the shank.

The tooth holder pocket is made complementary respective to the shank of the tooth. This provides a number of coacting surfaces by which a digging force is transmitted between the tooth and holder in a manner to minimize breakage of the tooth assembly. The tooth and holder are held assembled one to the other by a fastener means.

In one form of the invention,the confronting surfaces presented by the lower surface of the pocket and tooth shank each have a recess formed therein which are brought into alignment with one another whereby the tooth and holder are assembled, the two recesses are brought into register with one another and together form a single chamber. Within the chamber there is received a keeper apparatus comprised of spaced apart, rectangular, metal members having resilient material sandwiched therebetween which urge the spaced members apart. Preferably the resilient material is rubber. The keeper members and recesses are of a size whereby when the keeper is placed within the rectangular chamber and the tooth shank is received within the pocket, the keeper is compressed within the chamber and thereby locks the tooth and the holder together with great force until the keeper is compressed, thereby releasing the tooth from the holder.

A primary object of the present invention is the provision of a digging tooth and holder therefor made into a configuration that resists breakage while enhancing the digging action of the tooth.

Another object of this invention is the provision of a digging tooth and holder therefor, said tooth having a shank and said holder having a pocket of a configuration that enables a digging force to be applied to the working end of the tooth in a superior manner.

A further object of the present invention is the provision of a digging tooth and holder therefor which are mated together in a removable manner and which are of a configuration that enables digging in hard formations to be achieved.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENTS

Figure 1:
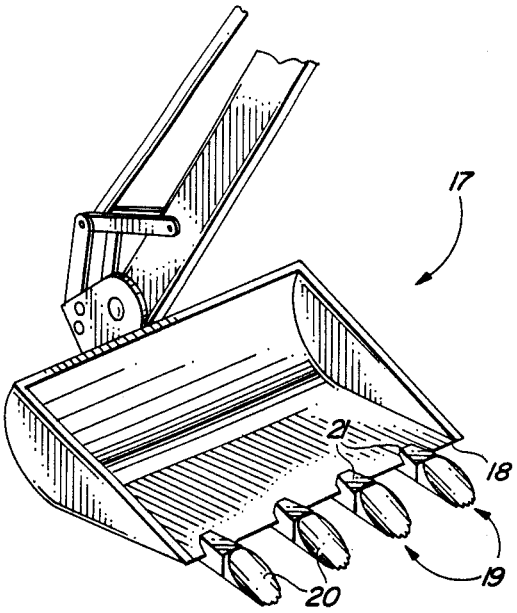
FIG. 1 is a fragmentary, perspective view showing part of an excavating machine having apparatus made in accordance with the present invention included therewith.
Figure 3:
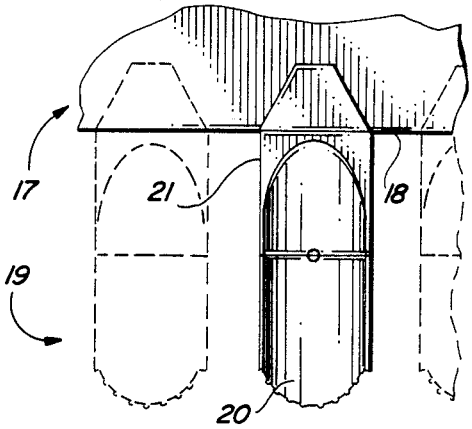
FIG. 3 is an enlarged, fragmentary, top plan view of part of the apparatus disclosed in FIG. 1.

In FIG. 1 of the drawings, there is disclosed a prior art excavating machine 17 having a digging bucket thereon of conventional design. The bucket has the usual lip 18 at the forward end thereof to which there is affixed a plurality of digging tooth assemblies 19, made in accordance with the present invention. The tooth assemblies 19 each include a digging tooth 20 removably received within a holder 21.

Figure 2:
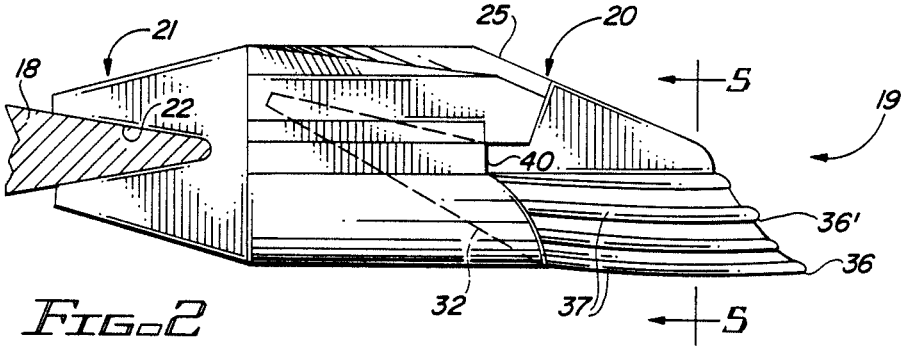
FIG. 2 is an enlarged, part cross-sectional, fragmentary, side view of part of the apparatus disclosed in FIG. 1.
Figure 5:
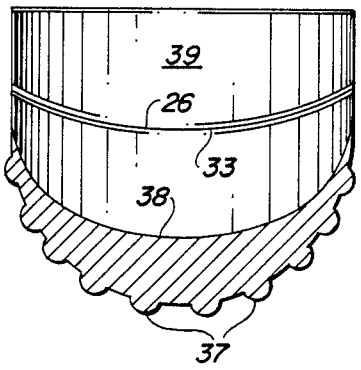
FIG. 5 is a cross-sectional view taken along line 5—5 of FIG. 2.

FIGS. 2–5 illustrate some of the details of a first embodiment of one of the digging tooth assemblies 19. As seen in FIG. 2, the holder 21 has a rearwardly opening lip receiving cavity or recess 22 within which the forward marginal edge of a lip 18 of a digging bucket is received.

Figure 4:
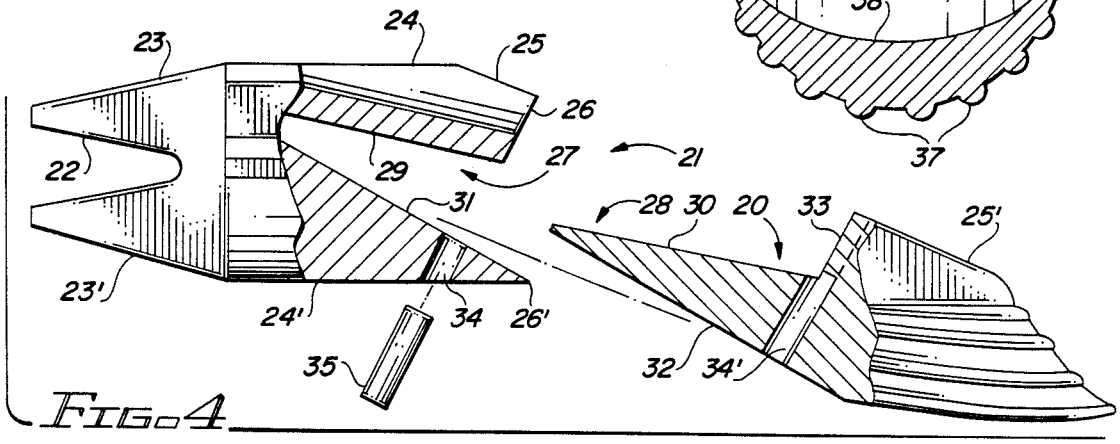
FIG. 4 is a part cross-sectional, disassembled, side elevational view of the apparatus disclosed in FIG. 2.

As seen in FIG. 4 of the drawings, together with FIGS. 1–3 and 5, the rear or trailing end of the holder 21 includes an upper surface 23 opposed to lower surface 23'. The medial part of the holder has an upper surface 24 opposed to a lower surface 24'. Surface 24 transitions into a downwardly sloped surface at 25, and terminates at a lateral, upstanding shoulder 26. The shoulder 26 defines the upper entrance into a shank receiving pocket 27 within a shank 28 of the digging tooth 20 is removably received in close tolerance relationship therewithin.

The interior walls that form the pocket 27 include a convex curved roof 29 against which there is slidably received a concave curved upper surface 30 of the shank 28. The surfaces 29 and 30 are complementary respective to one another. The floor 31 of pocket 27 is a concave curve and slidably receives the lower conical curved surface 32 of the shank 28 thereagainst. The surfaces 31 and 32 are also complementary respective to one another. As seen in various figures of the drawings, the upper and lower wall surfaces that cooperate to form the pocket 27 and shank 28 each converge toward one another in a rearward direction so that the area and thickness thereof diminishes rearwardly.

The tooth 20 has a lateral, upright shoulder 33 formed at the upper rear end thereof that separates the working end of the tooth from the tooth shank 28. The lateral shoulder 33 is positioned respective to the rest of the tooth assembly whereby it is slightly spaced from lateral shoulder 26 of the holder when the tooth shank is fastened within the holder pocket.

In FIG. 4, aperture 34 of the holder can be indexed or aligned with aperture 34' of the tooth so that when the tooth and holder are assembled into a tooth assembly, a fastener means 35 can be forced through the aligned passageways 34, 34' and thereby holds the tooth assembly releasably fastened respective to the holder. The pin 35 can take on a number of different forms but preferably is a common rolled pin. Provision is made for an aligned passageway in the upper part of the tooth holder for driving the pin from the passageway 34' to thereby permit the tooth to be released from the holder.

Numeral 36 indicates the forward end of the tooth that initially engages the ground. The lower cylindrical surface of the working end of the tooth is provided with ribs 37, which are semi-circular in cross-sectional configuration, and which commence at the forward terminal end 36 of the working end of the tooth 20 and continue in a rearward direction to terminate at the lower pocket entrance 26'. The lower surface of the tooth and pocket merge together in the indicated manner of FIG. 2. The upper surfaces 25, 38, and 39 of the tooth assembly also merge together in a similar manner. The ribs 37 are more or less parallel to one another and offer great structural reinforcement to the curved lower surface of the working end of the tooth.

The term "working end of the tooth" includes everything that is forward of the shank 28. This area extends from the forward cutting end 36, 36' of the tooth which initially engages or penetrates the earth, back to the shoulder 33 and lower pocket entrance 26'. It will be noted that the cutting edge of the tooth is projected forwardly at the lower terminal end 36 and is angled or sloped rearwardly and upwardly at 36', where it then joins the long sloped opposed sides of the tooth at 25' and the holder at 25.

The upper surfaces 38 and 39 of the tooth and the shank are curved inwardly to provide a longitudinally extending scoop which is concave in cross-section. The concaved, elongated configuration of the working end of the tooth assembly enables the upper surface 39 of the holder to receive material that is excavated by the leading cutting edge 36, 36' of the tooth. The excavated material is easily translocated or forced in a rearward direction from the scooped part 38 to the scooped part 39. The concaved, elongated, upper surface 38 and 39 of the tooth and the shank provide a structure which adds great structural integrity to the tooth assembly. The cylindrical lower surface of the working end of the tooth, the tooth shank, and the tooth holder are arranged respective to the upper curved surfaces thereof to provide maximum strength. The configuration of the lower cylindrical working end of the tooth, in conjunction with the concaved upper surface thereof, adds great strength to the tooth. The tooth is further strengthened by the addition of the ribs 37. The ribs 37, along with the upper and lower curved surfaces of the working end of the tooth, effectively increases the depth of the tooth so that the working end of the tooth exhibits great strength in compression, shear, and torsion. This new configuration of the working end of the first embodiment of the invention makes the tooth less prone to break as compared to other known tooth configurations, and enables the tooth assembly to efficiently excavate hard formations in an unexpected manner.

Figure 6:
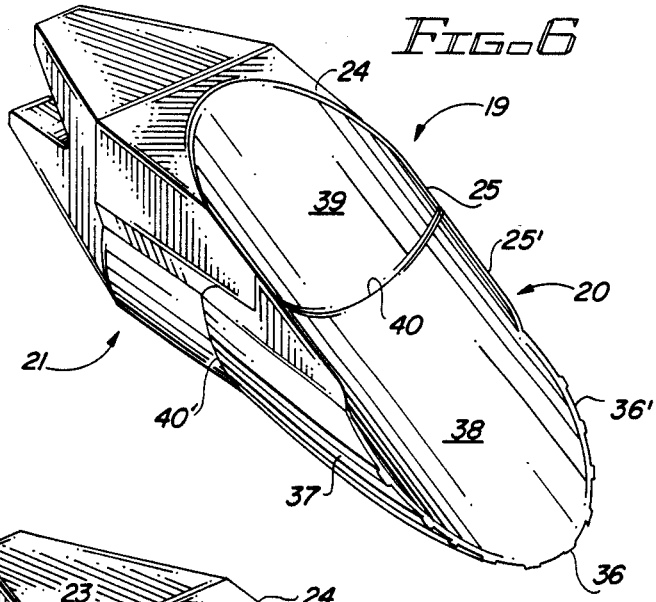
FIG. 6 is a perspective view of another embodiment of the present invention.
Figure 9:
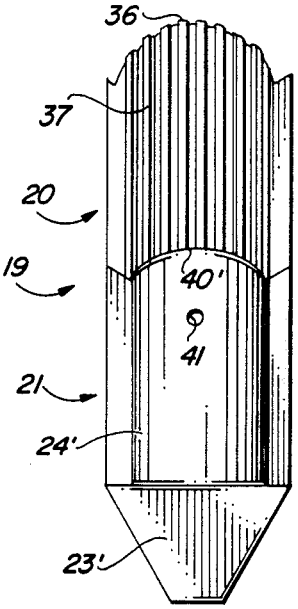
FIG. 9 is a bottom view of the apparatus disclosed in FIG. 8.
Figure 7:
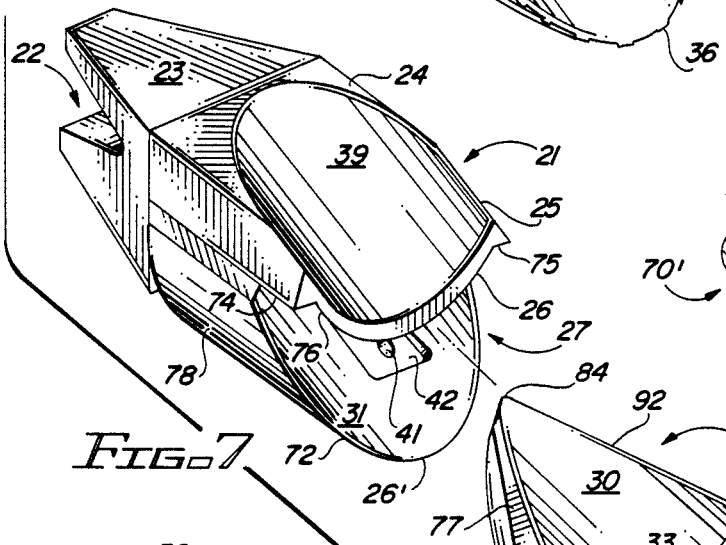
FIG. 7 is a disassembled, perspective view of the apparatus disclosed in FIG. 6.
Figure 15:
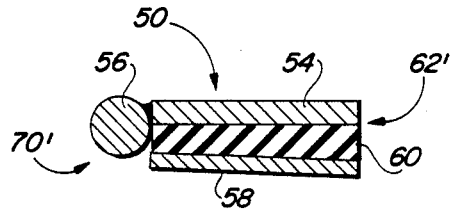
FIG. 15 is a cross-sectional view taken along line 15—15 of FIG. 14; and, FIG. 16 is a top plan view of the digging tooth set forth in FIG. 6.
Figure 8:
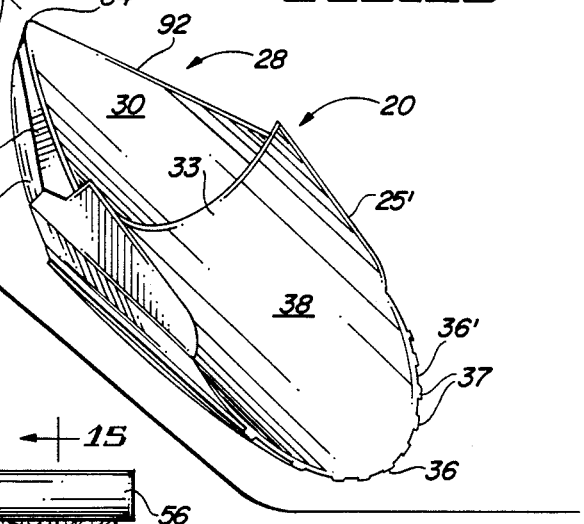
FIG. 8 is a top plan view of the apparatus disclosed in FIG. 6, with some parts being removed therefrom and some of the remaining parts being shown in cross-section.
Figure 8:
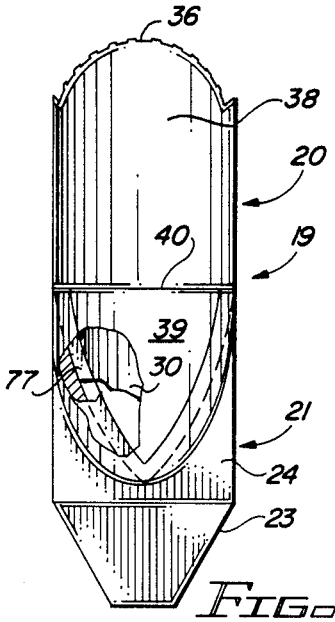
Figure 14:
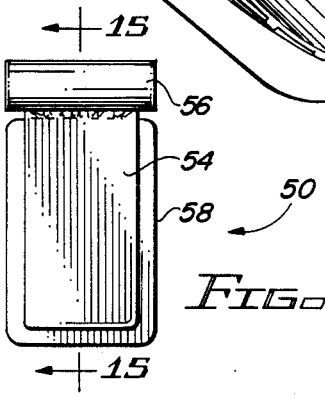
FIG. 14 is an enlarged, detailed, top plan view of part of the apparatus disclosed in some of the foregoing figures.

The second embodiment of the tooth assembly 19 is set forth in FIGS. 6–16. In FIGS. 6 and 7, the upper, outer surface 38 of the working end of the tooth 20 and the upper, outer surface 39 of the holder 21 are concave and extend from the forward terminal end 36 of the tooth at an upperwardly, inclined angle into intersection with the upper surface 24 of the holder 21. Numerals 40, 40' indicate the interface formed between the rear working end of the tooth 20 and the forward end of the holder 21. The holder 21, as seen in FIGS. 7 and 9, is provided with a passageway 41 that terminates within a wedge shaped recess 42 formed in the concave lower surface 31 of the pocket 27 of the holder. The wedge shaped recess 42 is seen to have a floor and opposed sidewalls which merge with the floor 31 of the pocket 27.

Figure 11:
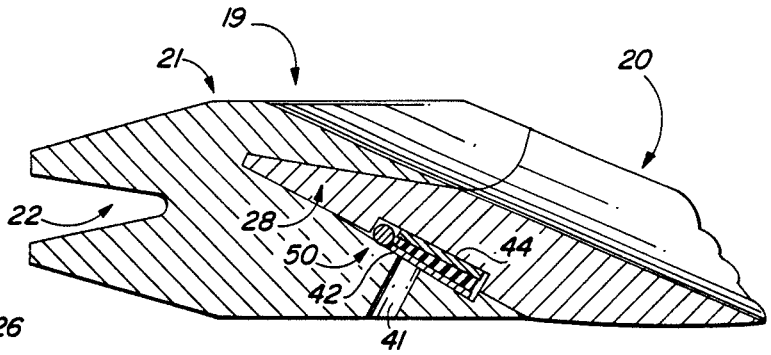
FIG. 11 is a longitudinal, vertical, cross—sectional view of the apparatus disclosed in FIGS. 8 and 9.
Figure 13:
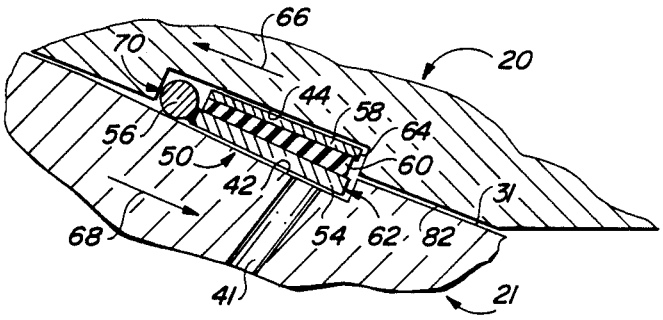
FIG. 13 is a fragmentary, enlarged, cross-sectional, detailed view of part of the apparatus seen in FIGS. 6–12.
Figure 12:
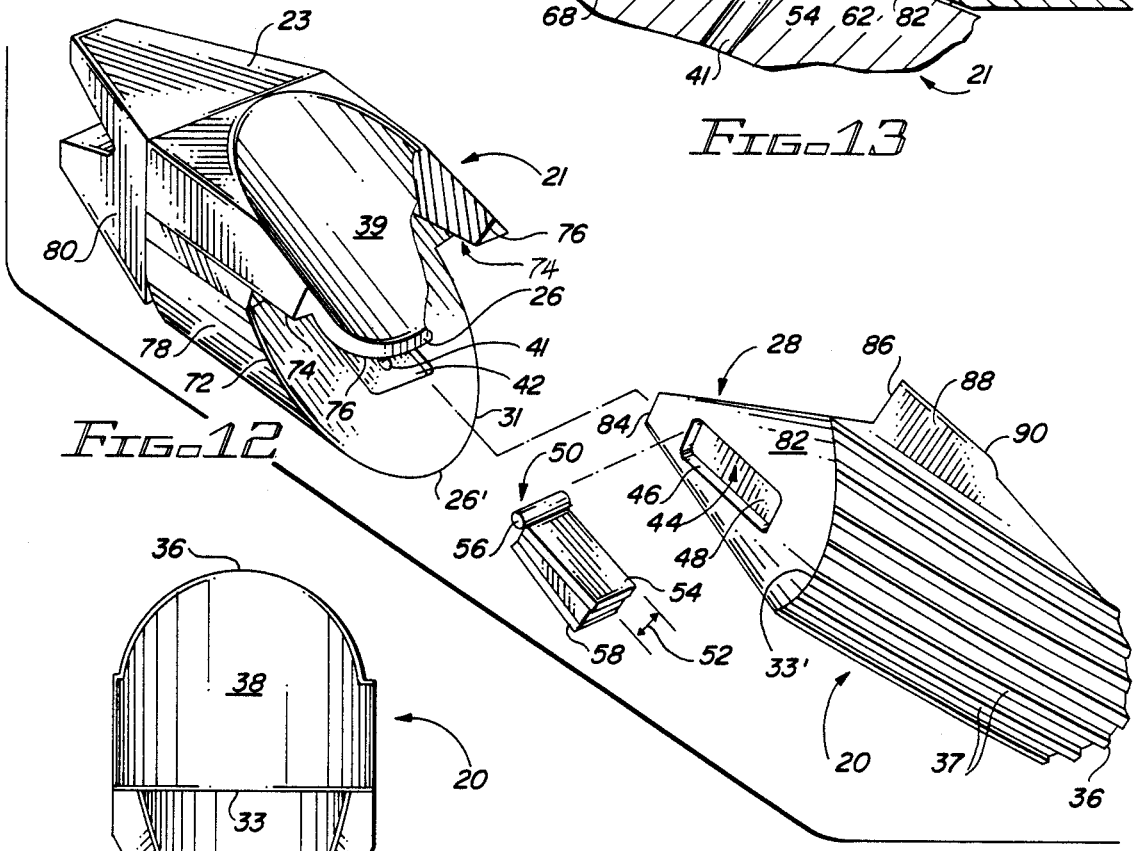
FIG. 12 is a disassembled, perspective view of the apparatus disclosed in FIG. 7, with some parts being removed therefrom and some of the remaining parts being shown in cross—section.
Figure 16:
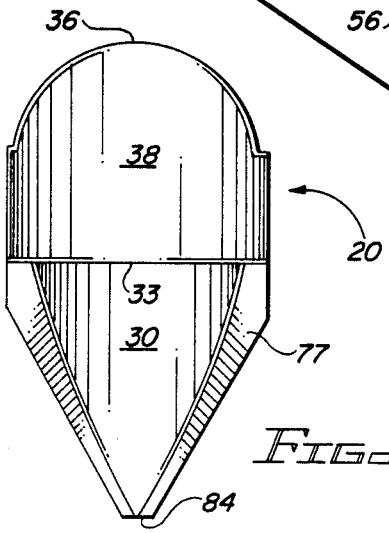

In FIGS. 11–13, it will be noted that the cylindrical lower surface of the tooth shank has a rectangular cavity 44 formed therein. When the digging tooth and holder are properly assembled to one another, the two recesses 42 and 44 are brought into alignment with one another and become a common retainer containing chamber. In FIGS. 11 and 13, together with other figures of the drawings, the chamber 44 formed in the tooth shank includes opposed sidewalls 46 and a ceiling 48. A keeper 50, made in accordance with the present invention, is of a thickness 52 that significantly exceeds the combined height of the chambers formed by the recesses of the tooth shank and holder pocket.

In FIGS. 12–15, the keeper 50 has a holder stop member 54 attached to a keeper nose piece 56. A tooth stop member 58 is slightly spaced from the nose piece 56 and further spaced from the holder stop member 54. A biasing member 60, preferably polymeric material such as rubber or rubber-like material, is attached to both the stop members 54 and 58. It will be noted that the two stop members 54 and 58 are placed at an angle respective to one another, and further that the floor and ceiling of the chamber is at a complementary single respective to the keeper 50, with the floor and ceiling of the chamber being significantly closer together as compared to the space between the outer surface and the stop members 54 and 58.

As particularly illustrated in FIGS. 11–13, numeral 62 indicates the confronting edges between the holder recess and keeper stop member 54 that abuttingly engage one another. Numeral 64 indicates the confronting edges between the tooth recess and keeper stop member 58 that abuttingly engage one another. Numeral 70 indicates the cooperative relationship between the nose piece 56 of the keeper and the rear end wall formed by the tooth shank recess.

The nose piece 56 facilitates assembly of the tooth to the holder by permitting the tooth 20 to be moved relative to the holder 21 with very little force as indicated by numeral 66. The nose piece 56 rides in the chamber 44 until the two recesses of the tooth and holder are moved into the latched position of FIGS. 11 and 13. Removal of the tooth 20 from the holder 21 occurs in the direction indicated by the arrow at numeral 68. This movement is resisted by the cooperative action between the various wall surfaces of the chamber and keeper 50.

Figure 10:
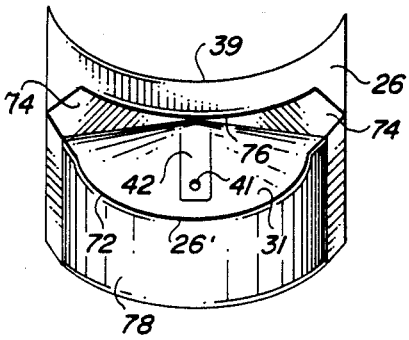
FIG. 10 is a front end view of part of the apparatus disclosed in FIGS. 7 and 12.

In FIGS. 7 and 12, numeral 72 indicates the downwardly and forwardly directed or sloped edge portion of the holder 21 which terminates at 26'. The upper end of the sloped part 72 terminates at forward projection 74. In FIG. 10, numeral 74 indicates an underlying shoulder that extends from lateral shoulder 26 rearwards where it terminates to form the rear of the pocket. Shoulder 74 is made complementary respective to shank shoulder 77. The pocket has a curved roof 76 spaced from the upper surface 39 of the holder. The roof 76 and surface 39 are similar curves.

Opposed shoulders 77 of the side edge portion of the shank 28 defines the outer perimeter of the upper curved surface 30 and lower cylindrical surface 82.

The lower wall surface 78 of the holder is curved from one opposed sidewall to the other, and terminates at the forward lower entrance 26' of the pocket. The curved wall surface 78 merges with the ribbed wall surface 37 of the working end of the digging tooth. The sides 80 of the holder (FIG. 12) can be made flat and may rearwardly converge towards one another as shown.

In FIGS. 7 and 12, the shank 28 has a lower convexed surface 82 that is a segment of a cone. The surface 82 is separated from the upper curved surface 30 by the before mentioned shoulder 77 that extends from the opposed sides of the lateral shoulder 33. The radius of curvature of the two surfaces 82 and 30 is such that they converge toward one another in a rearward direction and terminate at the rear terminal end 84. Hence, both the area and the thickness of the shank is reduced rearwardly.

In FIG. 12, edge portion 86 of the lateral shoulder 33 of the tooth 20 is received in spaced relationship respective to the forward projection 74 of the holder shoulder 26. Numeral 88 is an upwardly extending sidewall which separates the cylindrical bottom of the tooth from the upper concave surface 38. Numeral 90 indicates the edge of the tooth surface 38. Numeral 92 indicates the edge of the upper surface 30 of the shank 28.

The overall configuration of the present invention includes a tooth assembly 19 comprised of a digging tooth 20 and holder 21 therefor. The tooth assembly, as seen in FIG. 7, has a concaved upper surface 38 and 39 formed jointly by the working end of the tooth and the upper surface of the holder 21. The tooth assembly 19 includes a cylindrical lower surface 37, 78 which diverges rearwardly respective to the concaved upper surfaces 38 and 39. Longitudinally extending ribs 37 form the cylindrical lower surface. The ribs extend from the forward end 36 of the tooth rearwardly to merge at 26' with the holder. This configuration adds great structural strength to the tooth and holder, and permits the leading end 36 of the tooth to more easily penetrate a hard formation. The resulting excavated material flows rearwardly along the upper surfaces 38 and 39 of the tooth, and is subsequently received within a bucket, or is forced to move to another area by the action of a trencher wheel or chain, depending upon the specific use of the tooth.

The shank 28 of the tooth has an upper curved surface 30 arranged at an angle with respect to the lower curved surface 82, both of which terminate at the rear terminal end 84. This configuration of the shank permits great force to be imparted into the tooth structure, and subsequently into the working end of the tooth. The curved surfaces 30, 31, 38, 39, 78, and 82 can be a segment of a cylinder, a segment of a cone, an arc of a circle, a parabola, hyperbola, or ellipse, or a combination thereof.

The tooth pocket 27 is made complementary respective to the tooth shank 28 and includes the lateral shoulder 26 which is spaced from the lateral shoulder 33 of the tooth. Shoulders 77 formed on the edges of the shank 28 abuttingly engage a complementary shoulder 74 formed within the pocket. The pocket has a floor in the form of a lower conical surface 31 that rearwardly converges with respect to a roof in the form of an upper curved surface 76, so that both surfaces 31, 76, respectively, slidably receive in close tolerance relationship the opposed surfaces 30, 82 of the shank 28.

During the digging action, as the tooth 20 is forced rearwardly, the shank 28 is firmly seated within pocket 27. The surfaces 30, 82, 77 of the shank 28 are uniformly brought to bear against the surfaces 31, 76 of the tooth holder pocket and thereby evenly distribute the various digging loads; and, accordingly, reduce the likelihood of tooth breakage occurring when the working end of the tooth engages a harder formation.

A downward force exerted on the working end of the tooth is distributed between the coating upper surfaces 30 and 76 of the shank and pocket. At the same time, the shoulders 77, 74, 75 abuttingly engage one another. As the working end of the digging tooth is forced downward and rearward respective to the holder, the even distribution of the forces are transferred through the working end of the tooth, shank, pocket, holder, and into the supporting structure, such as the lip of a digging bucket, or a traveling chain of a trencher.

The opposed curved wall surface of the tooth assembly presents a monocoque-like structure that greatly strengthens the tooth. The tooth is wedge shaped, commencing with the relatively sharp leading edge of the tooth and reaching its maximum cross—section where the shank joins the rear working end of the tooth. From this point rearward, the thickness of the tooth again diminishes to form the shank which is tightly received within the pocket of the holder. This effectively provides a two piece structure comprised of the digging tooth and the holder which are joined together in a manner that closely approximates an integral digging tooth because of the manner in which the loads are transferred from the working end of the tooth into the attached end of the holder. This construction minimizes tooth breakage by maximizing the amount of power that can be absorbed by the working end of the digging tooth.

The tooth is assembled to the holder by inserting the keeper 50 within the recess 42 of the holder. The large lower member 58 is received within the large recess 42 so that the keeper 50 is properly oriented respective to the tooth and holder in the illustrated manner of FIGS. 11, 12, and 13.

As seen in the various figures of the drawings, the leading edge of the working end of the tooth is curved when viewed from the top, and the forward cutting edge slopes rearwardly towards the holder when viewed from the side, so that as the working end of the tooth engages the formation, the ribbed forward cutting edge is advanced through the formation as the excavated material is moved along the curved upper surfaces 38, 39 and forced rearwardly as the digging proceeds.

I claim:

1. A digging tooth and holder therefor for use in an excavating machine;

said tooth has a working art opposed to a shank; said holder has a shank receiving pocket, means by which said holder can be affixed to and thereby form part of an excavating machine; said tooth and shank having a bottom surface, a top surface, opposed sides, a forward and a rear end;

the bottom surface of said holder and tooth is upwardly curved in lateral cross-section, the top surface of said holder and tooth is upwardly curved in lateral cross-section; the bottom and top surfaces intersect at the forward end of the tooth and diverge from one another towards the shank;

a plurality of parallel, longitudinally arranged ribs form the bottom of said tooth, said ribs commence at the forward end of said working part and terminate adjacent said shank;

a first lateral shoulder is formed on said tooth at a location where said shank and said working part of said tooth are joined, another lateral shoulder is formed on said holder and defines the entrance into said pocket, said first lateral shoulder and said another lateral shoulder are arranged in confronting relationship respective to one another;

said shank has a concave upper surface and an upwardly curved lower surface which converge towards one another rearwardly; said pocket is made complementary respective to said shank whereby the pocket slidably receives the shank therewithin; and, retainer means by which the tooth and holder are removably assembled together.

2. The tooth and holder of claim 1 wherein said retainer means includes a first recess formed in the floor of said pocket and a second recess formed in the lower surface of the shank at a location whereby the first and second recesses are brought into registry with one another and form a chamber when the shank is received within the pocket;

a keeper received within said chamber which releasably locks the shank to the holder.

3. The tooth and shoulder of claim 2 wherein said keeper is comprised of first and second stop members spaced apart by an elastomeric material and arranged for being compressed towards one another within said chamber and for engaging the sidewalls of the first and second recesses to prevent relative movement between the tooth and holder.

4. The tooth and holder of claim 1 wherein the working part of said tooth is relatively thick adjacent said shoulder, and is progressively relatively thinner towards the forward end; said shank is relatively thick adjacent said shoulder and is progressively relatively thinner towards the rear end thereof.

5. The tooth and holder of claim 4 wherein there is a leading cutting edge on said tooth that terminates in a lowermost edge which curve upwardly and rearwardly and merges with an inclined tooth surface formed at said top surface.

6. The tooth and holder of claim 1 wherein said pocket has an upwardly curved floor, said retainer means includes a first recess formed in the floor of said pocket and a second recess formed in the lower surface of the shank at a location whereby the first and second recesses are brought into registry with one another and form a chamber when the shank is received within the pocket; and, a keeper received within said chamber which releasably locks the shank to the holder.

7. The tooth and holder of claim 6 wherein said keeper is comprised of first and second stop members spaced apart by an elastomeric material and arranged for being compressed towards one another within said chamber and for engaging the sidewalls of the first and second recesses to prevent relative movement between the tooth and holder.

8. A digging tooth assembly comprising a tooth and holder therefor, said tooth has a working end for engaging the ground and a shank at the end opposed thereto; said holder has a shank receiving pocket formed thereon, and means by which the holder can be attached to an excavating machine;

said digging tooth assembly having a leading end and a rear end, and has a concave upper surface inclined respective to an upwardly curving, cylindrical, lower surface, with the upper and lower surfaces terminating in a cutting edge at the leading end of the tooth assembly and terminating at said shank at the rear end thereof;

said holder has a concave supper surface that is a continuation of the concave upper surface of the tooth; said holder has an upwardly curving, cylindrical lower surface that is a continuation of the cylindrical lower surface of the tooth;

said shank has a convex upper surface and an upwardly curved lower surface which converges rearwardly and laterally to form a shoulder between said upper and lower surfaces;

said pocket is made complementary respective to said shank and includes a convex floor and a concave roof which converge laterally and rearwardly to form a shoulder therebetween which abuttingly engages the shoulder of said shank; said pocket receives the shank therein with the pocket roof and pocket floor contacting the shank upper surface and the shank lower surface;

said means by which the holder can be attached includes a first recess formed in the floor of said pocket and a second recess formed in the lower surface of the shank at a location whereby the first and second recesses are brought into registry with one another and form a chamber when the shank is received within the pocket; and, a keeper received within said chamber which releasably locks the shank to the holder.

9. The digging tooth assembly of claim 8 wherein a lateral shoulder defines the entrance into said pocket;

another lateral shoulder separates the shank from the convex upper tooth surface;

the lateral shoulders of the tooth and the holder are spaced from one another while the surfaces of the shank bear against the surface of the pocket.

10. The tooth and shoulder of claim 8 wherein said keeper is comprised of first and second stop members spaced apart by an elastomeric material and arranged for being compressed towards one another within said chamber for engaging the sidewalls of the first and second recesses to prevent relative movement between the tooth and holder.

11. The tooth and holder of claim 8 wherein the working part of said tooth is relatively thick adjacent said shoulder, and is progressively relatively thinner towards the forward end; said shank is relatively thick adjacent said shoulder and is progressively relatively thinner towards the rear end thereof.

12. The tooth and holder of claim 11 wherein the leading cutting edge of said tooth terminates in a lowermost edge which curves upwardly and rearwardly and merges with the inclined tooth face.

13. A tooth assembly for attachment to an excavating apparatus; said tooth assembly includes a digging tooth and a holder, said digging tooth includes a working end opposed to a shank attached thereto and depending therefrom by which the tooth is removably mounted within the holder;

an elongated, outwardly opening socket extending into said holder, said socket is formed by two intersecting surfaces each of which are curved about an axis spaced therfrom, to provide spaced interior wall surfaces which converge towards one another to form a shoulder therebetween, and thereby provides a wedge-like curved cavity; said interior wall surfaces, when viewed in lateral cross-section, is continuous to form an uninterrupted enclosure; a lateral shoulder defines the socket entrance; and, means by which said holder can be attached to an excavating apparatus;

said shank is made complementary respective to said socket and is wedgedly received in a removable manner therewithin;

said holder and tooth have a bottom surface which is upwardly curved and cylindrical in lateral cross-section, said holder and tooth have a top surface which is upwardly curved concavedly in lateral cross-section; a lateral shoulder formed at the rear of the working end which is spaced from the lateral shoulder of the holder;

a plurality of parallel, longitudinally arranged ribs form the bottom of the tooth, said ribs commence at the forward end of the working end and terminate adjacent the shank; a lateral shoulder is formed between the opposed surfaces of said shank which abuttingly engages a complementary shoulder formed within the pocket;

one of the interior walls of the socket is a floor; retainer means which includes a first recess formed in the floor of said socket and a second recess formed in the lower surface of the shank at a location whereby the first and second recesses are brought into registry with one another and form a chamber when the shank is received within the socket; and, a keeper received within said chamber which releasably locks the shank within the socket of the holder.

14. In a digging apparatus of the type having a digging tooth removably mounted respective to a tooth receiving holder, wherein the holder is affixed to the digging apparatus and includes a socket formed therein within which a shank of the tooth is removably received, the improvement comprising:

said socket of said holder outwardly opens and rearwardly tapers so that the socket is progressively reduced in size; said socket is formed by spaced curved interior wall surfaces joined together at opposed sides and the rear, the interior peripheral wall surface of the socket is continuous when viewed in lateral cross-section.

said tooth includes a cutting part at one end thereof, said tooth shank rearwardly extends from said cutting part and is rearwardly tapered complementary respective to said socket;

said shank has an upper concave surface and a lower cylindrical surface when viewed in lateral cross-section; said shank of said tooth is telescopingly received within said socket of said holder where said shank is wedgedly held in assembled relationship therewith;

said upper and lower surfaces are spaced from one another by lateral shoulders formed on opposed sides of said shank for engagement with complementary shoulders formed within said socket;

and there further being one lateral shoulder formed between the upper surface of the tooth and the upper surface of the shank;

another lateral shoulder forms the socket entrance into the holder;

said one lateral shoulder and said another lateral shoulder confront one another; said tooth and holder are symmetrical on either side of a vertical plane that passes longitudinally through the tooth and holder;

one of the interior walls of the socket is a floor; retainer means which includes a first recess formed in the floor of said socket and a second recess formed in the lower surface of the shank at a location whereby the first and second recesses are brought into registry with one another and form a chamber when the shank is received within the socket; and, a keeper received within said chamber which releasably locks the shank within the socket of the holder.

15. The tooth and holder of claim 14 wherein the working part of said tooth has a forward end opposed to said shank, and a relatively large thickness adjacent said lateral shoulder, and is progressively relatively thinner towards the forward end; said shank has a rear end opposed to said lateral shoulder, and a relatively large thickness adjacent said lateral shoulder and is progressively relatively thinner towards the rear end thereof.

16. The tooth and holder of claim 14 wherein said tooth has a concave inclined upper surface and a cylindrical lower surface, the cutting part of said tooth terminates in a lowermost edge which curves upwardly and rearwardly and merges with the inclined upper surface.

17. The tooth and holder of claim 16 wherein said keeper is comprised of first and second stop members spaced apart by an elastomeric material and arranged for being compressed towards one another within said chamber and for engaging the sidewalls of the first and second recesses to prevent relative movement between the tooth and holder, one said stop member includes a curved nose piece for enhancing assembly of the tooth and holder.

* * * * *

UNITED STATES PATENT AND TRADEMARK OFFICE

CERTIFICATE OF CORRECTION

PATENT NO. : 4,835,888

DATED : JUNE 6, 1989

INVENTOR(S) : CHARLES W. HEMPHILL

It is certified that error appears in the above-identified patent and that said Letters Patent is hereby corrected as shown below:

Column 6, line 4, substitute --angle-- for "single";
Line 7, substitute --of-- for "and";
Column 8, Line 29, substitute --part-- for "art".

Signed and Sealed this

Thirteenth Day of February, 1990

*Attest:*

JEFFREY M. SAMUELS

*Attesting Officer*

*Acting Commissioner of Patents and Trademarks*